United States Patent [19]
Kato
[11] 4,317,639
[45] Mar. 2, 1982

[54] WRITING IMPLEMENT WITH IMPROVED CARTRIDGE HOLDER

[76] Inventor: Dane D. Kato, 1400 Addison St., Berkeley, Calif. 94702

[21] Appl. No.: 106,933

[22] Filed: Dec. 26, 1979

[51] Int. Cl.³ ..... B43K 7/10
[52] U.S. Cl. ..... 401/209; 401/199
[58] Field of Search ..... 401/88, 140, 208, 209, 401/210, 216, 196, 198, 199

[56] References Cited

U.S. PATENT DOCUMENTS

| | | | |
|---|---|---|---|
| 3,325,851 | 6/1967 | Roller | 401/198 |
| 3,446,563 | 5/1969 | Burnham | 401/199 |
| 3,776,646 | 12/1973 | Bich | 401/199 |
| 3,966,336 | 6/1976 | Lotfallah | 401/209 |
| 4,057,354 | 11/1977 | Bajusz et al. | 401/199 |

FOREIGN PATENT DOCUMENTS

| | | | |
|---|---|---|---|
| 2745608 | 4/1979 | Fed. Rep. of Germany | 401/209 |

*Primary Examiner*—Edward M. Coven
*Attorney, Agent, or Firm*—Boniard I. Brown

[57] ABSTRACT

The refill cartridge of a writing implement is retained in a hollow tubular assembly having an interior frustroconical portion at one end to receive and retain a tapered split collar portion of a cartridge retaining tip. The tapered split collar has an interior surface which may include at least one interior radial surface which along with friction between the collar interior surface and the refill cartridge locks the refill in proper position when stressed inwardly by insertion of the tapered split collar in the frustroconical portion of the tubular barrel.

6 Claims, 5 Drawing Figures

WRITING IMPLEMENT WITH IMPROVED CARTRIDGE HOLDER

BACKGROUND OF THE INVENTION

Writing implements such as ballpoint pens, felt tip pens and other type devices are commonly constructed from two main parts, a refill cartridge and a tubular barrel in which the refill cartridge is retained by friction and a back cap. Normally, the cartridge is inserted from the back end of the tubular barrel into a tip molded or positioned therein. Thereafter the cap is inserted into the barrel which bears against the back end of the refill to retain the refill in proper position extending through the tip for writing. Unfortunately, the rear caps have a tendency to become loose with use or lost from nervous manipulation thereof. When this occurs, the refill tends to back out of the barrel making writing with the implement a frustrating and sometimes impossible project.

Therefore there has been a need to provide improved means to retain a writing implement refill within a tubular barrel.

BRIEF DESCRIPTION OF THE INVENTION

In the present invention the refill is retained within a tubular barrel by providing a molded barrel tip which snugly fits over the ink distributing tip of the refill. The molded barrel tip includes a split collar which extends over the portion of the refill at which the tip and the ink retaining cylinder portion thereof are mated. Therefore the refill tip extends through the barrel tip and the split collar.

The split collar has an inner surface which is frustroconically tapered inwardly toward the tip end when the split collar is unstressed. When the split collar is inserted along with the refill into the barrel, which has a tapered frustroconical inner wall portion which tapers inward as its distance from the tip thereof increases, the collar squeezes down over the refill to retain it in position for writing. A tipward facing radial surface may be provided on the inner surface of the split collar in position to engage a ridge normally formed along the ink retaining receptacle where the writing implement tip assembly ends. This locks the refill against rearward movement so that the friction between the refill and the split collar need not be relied upon.

It is therefore an object of the present invention to provide an improved writing implement.

Another object is to provide a refillable writing implement with improved refill retaining means.

Another object is to provide a writing implement refill holder which can be constructed from plastic at low cost and with relatively simple molds.

Another object is to provide a refillable writing implement tip which in addition to retaining the refill cartridge provides venting for the implement.

These and other objects and advantages of the present invention will become apparent to those skilled in the art after considering the following detailed specification and the accompanying drawing wherein:

DETAILED DESCRIPTION OF THE SHOWN EMBODIMENT

Figures 1, 2, 3, 4, 5:
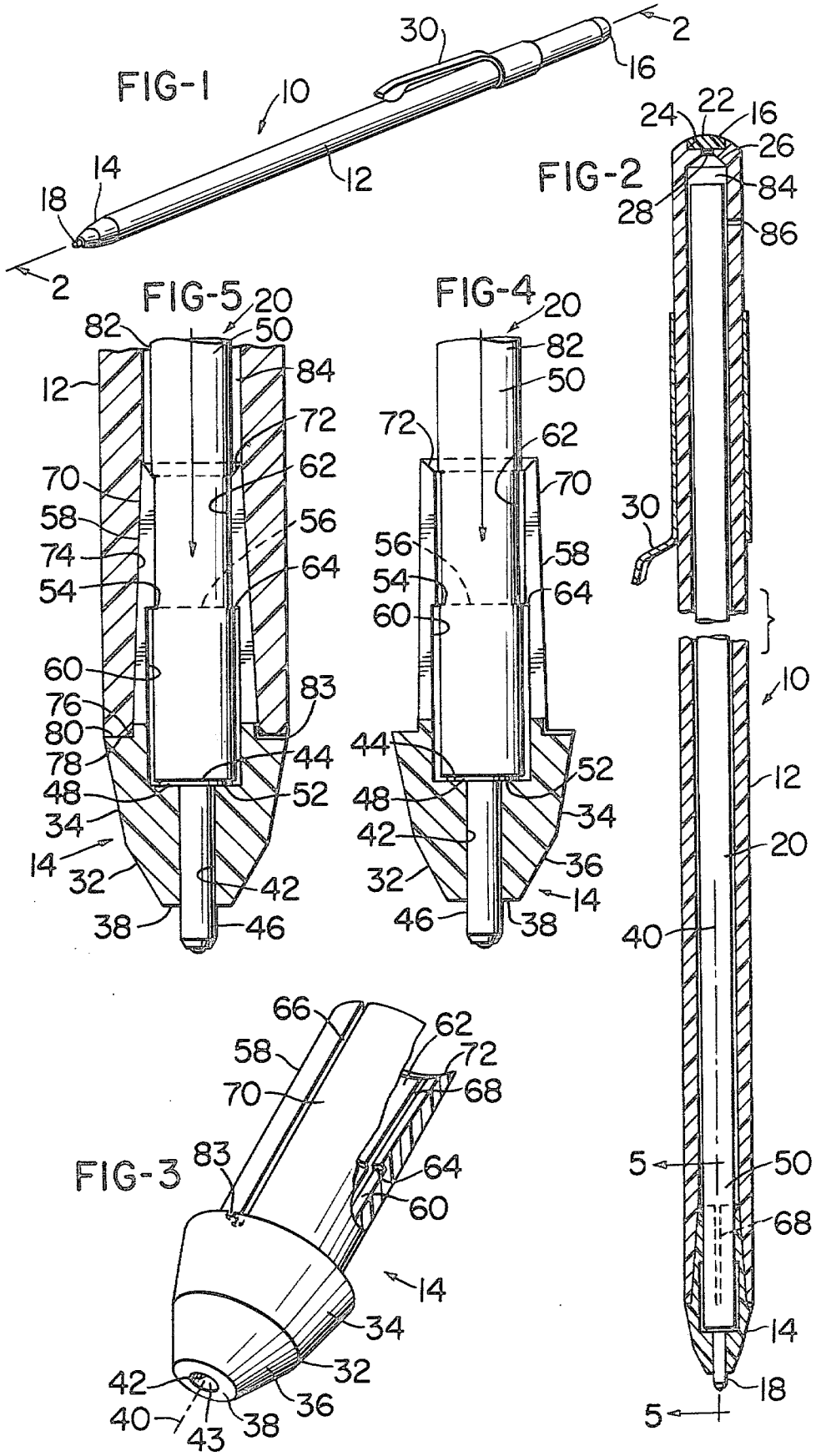
FIG. 1 is a perspective view of a writing implement constructed according to the present invention.
FIG. 2 is an enlarged cross-sectional view of the writing implement of FIG. 1 taken on line 2—2 of FIG. 1.
FIG. 3 is an enlarged perspective view of the tip portion of the implement of FIGS. 1 and 2.
FIG. 4 is an enlarged cross-sectional view of the tip of the present invention in place around a refill.
FIG. 5 is an enlarged cross-sectional view taken at line 5—5 of FIG. 2 showing the retaining configuration of the present invention.

Referring to the drawings more particularly by reference numbers, number 10 in FIG. 1, refers to a writing pen constructed according to the present invention. Although the pen 10 shown is one of the ballpoint type, any of numerous refillable type writing implements could be substituted therefor.

The pen 10 includes a tubular barrel 12, a barrel tip 14 and an opposite end 16 with the writing tip 18 of the refill cartridge 20 extending through the barrel tip 14 as shown in FIG. 2. The end 16 of the barrel portion 12 may be closed either integrally or by means of an end insert 22 which is retained within a cylindrical depression 24 in the end 16 and supported by an annular inwardly extending flange 26 which contacts the underside 28 thereof. The pen 10 also may include a clip 30 and tip covering cap, not shown.

Referring to FIG. 3, the barrel tip 14 includes an end portion 32 formed by two intersecting frustroconical surfaces 34 and 36 with the angle of the surface 36 which is adjacent a ring shape radial end 38 of the end portion 32 being greater with respect to the axis 40 of the pen 10 than the surface 34. An inner cylindrical surface 42 defines a hole 43 through the barrel tip 14 aligned with the axis 40. As shown in FIG. 4, the surface 42 extends to a radial abutment surface 44 concentric therewith. Most refill cartridges 20 include a hard writing tip 18 which in the case shown includes a ball supporting cylinder 46 behind which there is an enlarged cylindrical portion 48 over which a writing fluid receptacle 50 is retained. Normally, there is a radial abutment surface 52 between the two cylinders 46 and 48 and concentric therewith and this is used to abut the radial abutment surface 44 of the barrel tip 14 to limit the extension of the cartridge 20 through the end 38.

The receptacle 50 normally is constructed from plastic or other soft material which is stressed about the cylinder 48 so that a concentric step 54 results at the end 56 of the cylinder 48 away from the cylinder 46. Even when metal tubing is used for the receptacle 50, it normally is crimped to the cylinder 48 so that the step 54 occurs. The barrel tip 14 has a split collar portion 58 which includes two interior frustroconical surfaces 60 and 62 with a tip facing radial abutment surface 64 therebetween. Normally, a plurality of slits, such as slits 66 and 68, shown in FIG. 3, are provided in the collar 58. The outer surface 70 of the collar 58 is essentially cylindrical when unstressed and the surfaces 62 and 70 are joined by an annular surface 72 which may be frustroconical in shape as shown to enable easy insertion of the cartridge 20 therein.

In FIG. 5, the collar 58 is shown in its normally stressed condition with the cylindrical surface 58 thereof in contact with a frustroconical surface 74 within the barrel 12 which tapers inwardly as it extends toward the end 16 of the barrel 12. The tip 14 with the refill cartridge 20 can be inserted easily within the barrel 12 because of an inwardly tapered frustroconical relief surface 76 adjacent the radial end surface 78 thereof. The frustroconical surface 76 enables the receptacle 50 and the collar 58 to slide easily within the barrel 12 until the outer cylindrical surface 70 of the collar 58 comes in contact with the frustroconical surface 74. Further movement stresses the collar 58 inwardly at least partially closing the slits 66 and 68 so that as the surface 78 comes into abutment with a facing radial abutment surface 80 on the tip 14, the collar 58 forcefully engages the outer surface 82 of the receptacle 50 to frictionally engage therewith. In addition, the step 54 interlocks with the radial abutment surface 64 to assure that the refill cartridge 20 is firmly locked in position within the pen 10. This locking is maintained until the tip 14 is removed from the barrel 12 to enable easy replacement of the refill cartridge 20 with another similarly shaped.

The slits such as slit 66 can extend to the surface 80 which is shown including a groove 83 to vent the interior 84 of the pen 10. In the alternative, a conventional venting hole 86 can be provided along the barrel 12.

Thus there has been shown and described a novel refillable writing implement which fulfills all of the objects and advantages sought therefore. Many changes, alterations, variations and other uses and applications of the subject invention will however become apparent to those skilled in the art after considering this specification and the accompanying drawing. All such changes, modifications, variations and other uses and applications which do not depart from the spirit and scope of the invention are deemed to be covered by the invention which is limited only by the claims which follow.

What is claimed is:

1. A writing implement having:

a writing cartridge having a writing tip assembly and a writing fluid receptacle connected thereto; said writing fluid receptacle having an outer surface and extending over a portion of said writing tip assembly, said writing tip assembly having a back end within said writing fluid receptacle which forms a lip on said outer surface of said writing fluid receptacle, a tubular barrel for enclosing at least said writing fluid receptacle of said writing cartridge, said tubular barrel having first and second ends, said first end including an interior frustroconical surface which tapers inwardly as it extends toward said second end;

a barrel tip having a tip surface on one end thereof and a split collar at the opposite end, said split collar having an inner surface being frustroconical in shape tapering inwardly as it extends toward said tip surface when in an unstressed condition and sized to mate with a portion of said writing cartridge, and an outer surface essentially cylindrical in shape when in an unstressed condition and sized to mate and be stressed inwardly by insertion within said interior frustroconical surface of said tubular barrel, said inner surface of said split collar having a tipward facing radial abutment surface formed therein positioned to engage said lip on said outer surface of said writing fluid receptacle when said split collar is stressed by said interior frustroconical surface of said tubular barrel, said writing tip assembly further including a tip facing radial abutment surface adjacent said writing fluid receptacle and said barrel tip further including a barrel facing radial abutment surface positioned for engagement with said barrel, at least one slit defined in said split collar, said slit having an extension groove which extends across said barrel facing radial abutment surface to vent said barrel, and a radial abutment surface positioned to abut said tip facing radial abutment surface of said writing tip assembly whereby said writing cartridge is retained between said tipward facing radial abutment surface of said split collar and said radial abutment surface of said barrel tip.

2. The writing implement as defined in claim 1 wherein said split collar has a barrel facing end frustroconical surface which is tapered inwardly as it extends toward said tip to enable easy insertion of said writing cartridge into said barrel tip.

3. The writing implement as defined in claim 2 wherein said barrel includes a tip facing radial abutment surface at said first end thereof and a frustroconical surface connecting said tip facing radial abutment surface to said interior frustroconical surface of said barrel to enable easy insertion of said split collar in said barrel.

4. The writing implement as defined in claim 2 wherein said barrel tip is constructed from molded plastic.

5. A writing implement having:

a writing cartridge having a writing tip assembly and a writing fluid receptacle connected thereto;

a tubular barrel adapted to enclose at least said writing fluid receptacle of said writing cartridge, said tubular barrel having first and second ends, said first end including an interior frustroconical surface which tapers inwardly as it extends toward said second end; and a barrel tip for holding said writing cartridge to said tubular barrel having a tip surface on one end thereof and a split collar at the opposite end, said split collar having a frustroconical inner surface which is tapered inwardly as it extends toward said tip surface and which is sized to mate with a portion of said writing cartridge when stressed inwardly thereabout and an outer surface sized to mate with and be stressed inwardly by insertion within said interior frustroconical surface of said tubular barrel, said writing fluid receptacle further including an outer surface, a portion of which extends over a portion of said writing tip assembly, said writing tip assembly further including a back end positioned within said writing fluid receptacle which forms a lip on said outer surface of said writing fluid receptacle, said inner surface of said split collar having a tipward facing radial abutment surface formed therein positioned to engage said lip on said outer surface of said writing fluid receptacle when said split collar is stressed by said interior frustroconical surface of said tubular barrel to lock said writing cartridge in said barrel tip and said tubular barrel.

6. The writing implement as defined in claim 5 wherein said writing tip assembly includes a tip facing radial abutment surface adjacent said writing fluid receptacle and said barrel tip includes a radial abutment surface positioned to abut said tip facing radial abutment surface of said writing tip assembly whereby said writing cartridge is retained between said tipward facing radial abutment surface of said split collar and said radial abutment surface of said barrel tip.

* * * * *